US007836637B2

(12) United States Patent
Iannelli

(10) Patent No.: US 7,836,637 B2
(45) Date of Patent: Nov. 23, 2010

(54) VALLEY DIVERTER FOR A GUTTER COVER

(76) Inventor: Anthony M. Iannelli, 1140 Pamela Dr., Cincinnati, OH (US) 45255

( * ) Notice: Subject to any disclaimer, the term of this patent is extended or adjusted under 35 U.S.C. 154(b) by 260 days.

(21) Appl. No.: 10/935,950

(22) Filed: Sep. 8, 2004

(65) Prior Publication Data

US 2006/0048456 A1 Mar. 9, 2006

(51) Int. Cl.
*E04D 13/00* (2006.01)

(52) U.S. Cl. ..... 52/12; 52/11; 52/13; 52/97

(58) Field of Classification Search ..... 52/11–15, 52/24, 97; 404/2, 4; 405/39; 5/663; 210/162; 312/229, 213; 108/24, 25, 27; 4/286–292
See application file for complete search history.

(56) References Cited

U.S. PATENT DOCUMENTS

| | | | | | |
|---|---|---|---|---|---|
| 109,067 | A * | 11/1870 | Smith, Jr. | ..... | 404/4 |
| 2,334,779 | A * | 11/1943 | Luff | ..... | 52/97 |
| D181,753 | S * | 12/1957 | Scanland et al. | ..... | D25/112 |
| 3,710,405 | A * | 1/1973 | Watts | ..... | 5/201 |
| 4,944,050 | A * | 7/1990 | Shames et al. | ..... | 4/609 |
| 5,536,113 | A * | 7/1996 | McGregor | ..... | 405/125 |
| 6,009,672 | A * | 1/2000 | Kuhns | ..... | 52/13 |
| 6,412,229 | B2 * | 7/2002 | Kuhns | ..... | 52/13 |
| 6,877,281 | B1 * | 4/2005 | Gavin | ..... | 52/19 |
| 2003/0194269 | A1 * | 10/2003 | Garza | ..... | 404/2 |

* cited by examiner

*Primary Examiner*—Robert J Canfield
*Assistant Examiner*—Christine T Cajilig
(74) *Attorney, Agent, or Firm*—Frost Brown Todd LLC

(57) ABSTRACT

The leading wall of the valley diverter has a convex outer surface and is adapted to be axially aligned with a downwardly extending valley disposed between converging roof slopes. First and second generally straight side walls extend and taper downwardly from opposite ends of the leading wall and define an angle of ninety degrees or less. A support member extends between the leading wall and the side walls and comprises a canopy and an intermediate wall extending between the side walls, or a larger canopy that is coextensive with the side walls, or a mounting flange extending generally horizontally and inwardly from lower ends of the leading wall and the side walls.

21 Claims, 5 Drawing Sheets

VALLEY DIVERTER FOR A GUTTER COVER

BACKGROUND OF THE INVENTION

A gutter cover comprises a series of elongated sections of sheet metal adapted for attachment to a roof gutter in overlying relation thereto. Recessed apertures in the gutter cover guide rainwater flowing off of the roof into the gutter. Typically, the gutter cover is formed with a large upper surface. Although it may be slightly ridged, slotted or apertured, the upper surface is generally planar so that leaves, twigs and other debris do not get stuck on it. In this manner, the need to periodically clean the gutter is substantially reduced.

In order to prevent foundation and drainage problems, the gutter cover must guide most, if not all, of the rainwater into the gutter. The relatively large planar upper surface of the cover is not particularly helpful in this regard. As a result of being designed so that tree leaves and the like slide off of it easily, the upper surface tends to let a substantial portion of the rainwater flow off of it as well. Typically, the gutter cover is formed with an elongated trough below the upper surface to catch the rainwater and channel it into the gutter.

The runoff problem is more acute where adjacent slopes of the roof meet. Rainwater is channeled and accelerated by the flashing in the valleys between adjoining roof slopes. It reaches the gutter cover at greater speed and volume than the rainwater flowing off of a single roof slope. The gutter cover configuration just below the valley is not particularly advantageous. As the roof slopes converge at the valley, the gutter cover sections running parallel to and below the slopes converge just below the valley. The gutter cover sections come together at an angle, and the adjoining ends are usually mitered and overlapped. Doing so compromises the cover's ability to channel the rainwater into the gutter because the trough below the upper surface is altered by being mitered and overlapped. Thus, gutter cover configurations that are adequate for individual roof slopes may not prevent runoff below the valleys, particularly during a hard rain.

To meet this problem in the past, rainwater diverters were installed on the upper surface of the gutter cover in axial alignment with the roof valley. However, prior art valley diverters had some shortcomings. Some comprised an inverted V-shaped leading section and two trailing sections spaced a short distance behind and laterally of the leading section. These diverters had a tendency to trap sticks, leaves and other debris between the leading and trailing sections. Other diverters were formed with fins that projected angularly upwardly from the upper surface of the cover in the direction of travel of the rainwater. These diverters had a tendency to allow too much water to flow over them and hence were less than fully effective at preventing runoff.

Thus, the present inventor was faced with the problems of improving the ability of the diverter to prevent runoff while at the same time being relatively inexpensive to construct and install and, once installed, remain substantially free of leaves, twigs and other debris.

BRIEF SUMMARY OF THE INVENTION

A valley diverter according to the present invention basically comprises a leading wall having a convex outer surface, first and second generally straight side walls extending and tapering downwardly from opposite ends of the leading wall and defining an angle of ninety degrees or less, and a support member extending between the leading wall and the side walls.

DETAILED DESCRIPTION OF THE PREFERRED EMBODIMENTS

Figure 1:
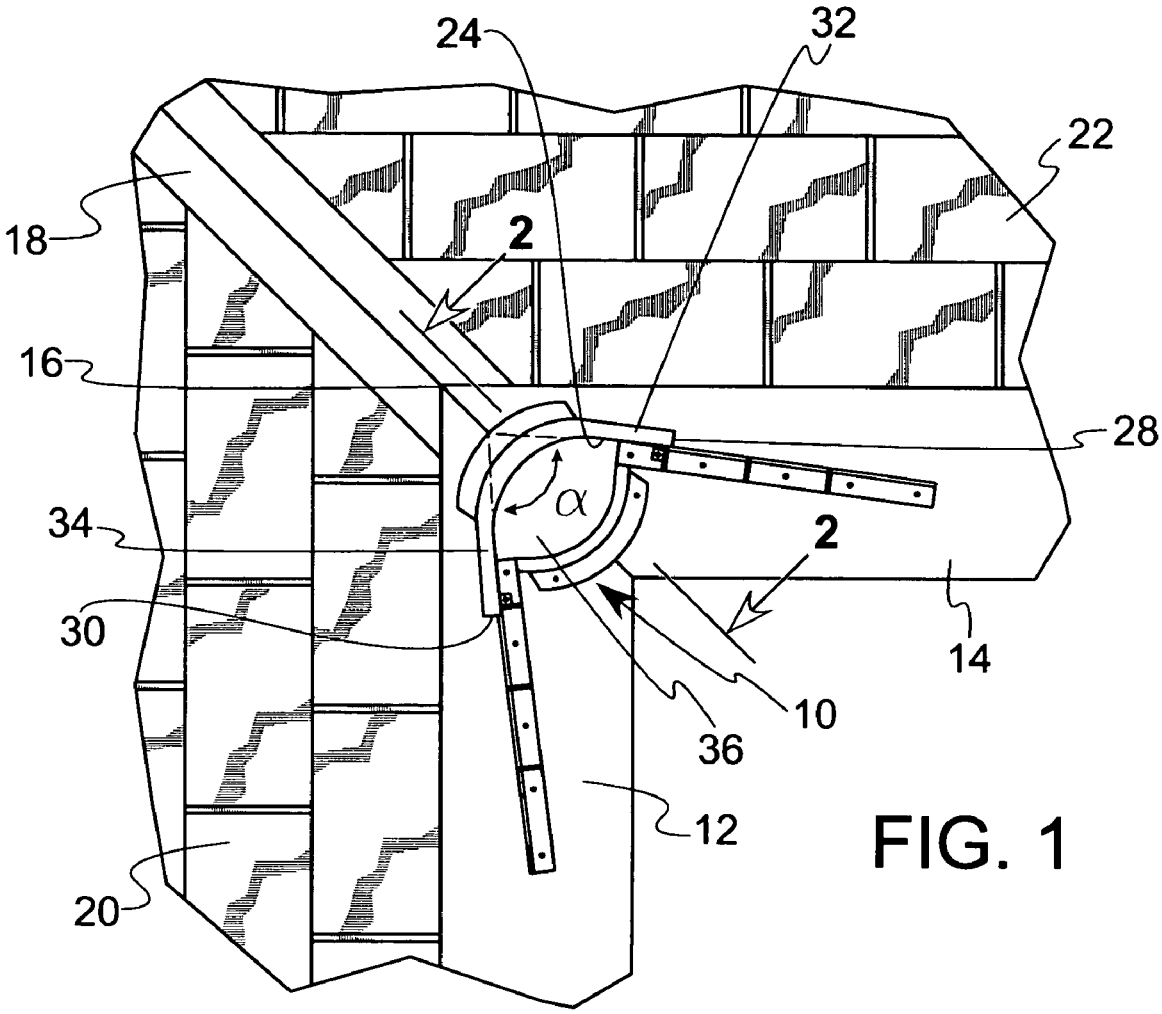
FIG. 1 is a top plan view of a first embodiment of a valley diverter according to the present invention.

As illustrated in FIG. 1, a first embodiment of a valley diverter, generally designated 10 and according to the present invention, is adapted to be mounted on angularly adjoining gutter cover sections 12, 14 adjacent to a lower end 16 of a valley 18 between two adjacent roof slopes 20, 22. The present valley diverter 10 comprises a leading wall 24 having a convex outer surface 26 (FIG. 5), first and second generally straight side walls 28, 30 extending from and tapering downwardly from opposite ends 32, 34 of the leading wall 24 (FIGS. 3 and 4) and defining an angle a of ninety degrees or less, and a support member 36 extending between the leading wall 24 and the side walls 28, 30.

Figure 2:
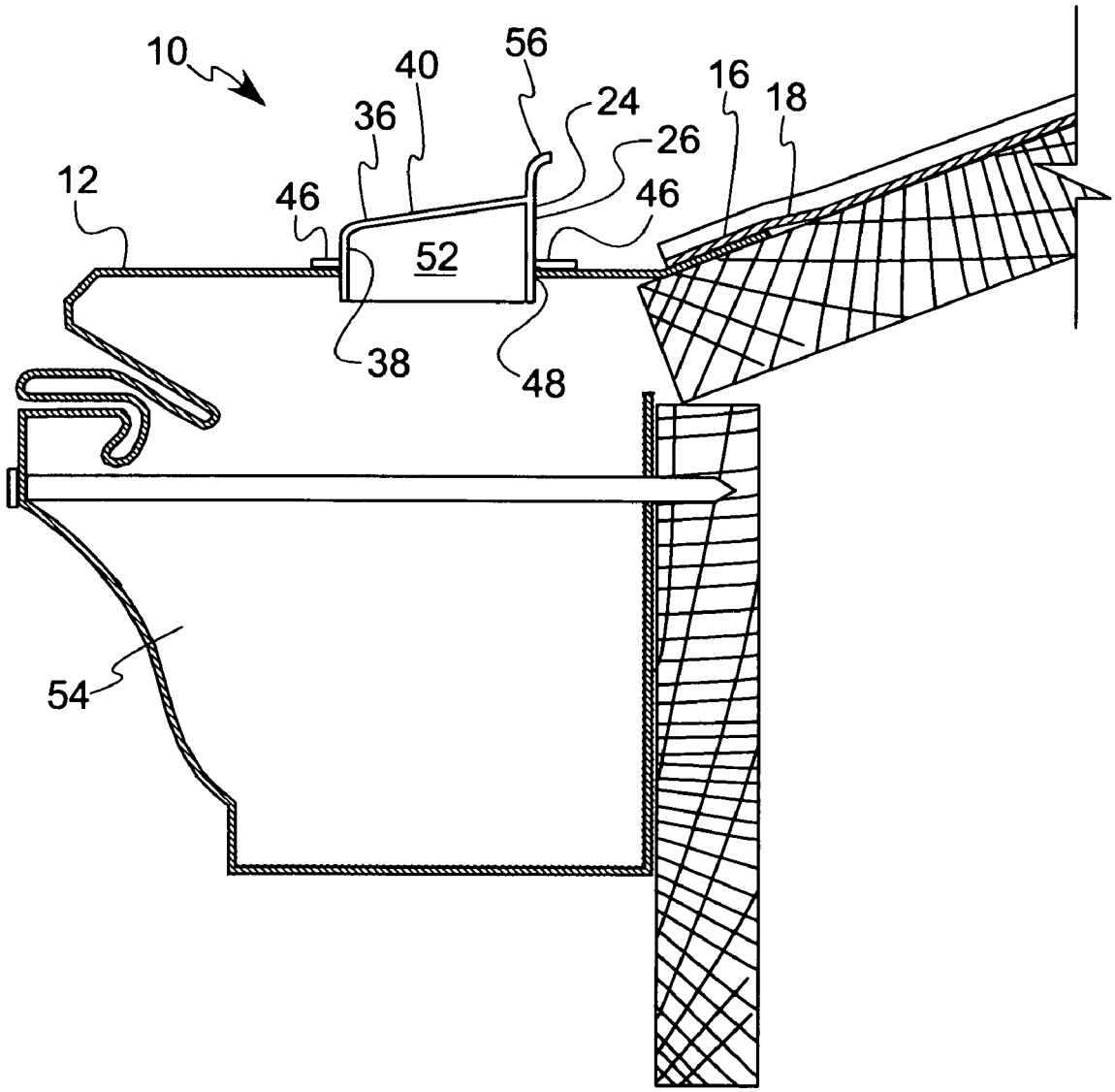
FIG. 2 is an enlarged sectional view thereof taken along line 2-2 of FIG. 1.
Figure 3:
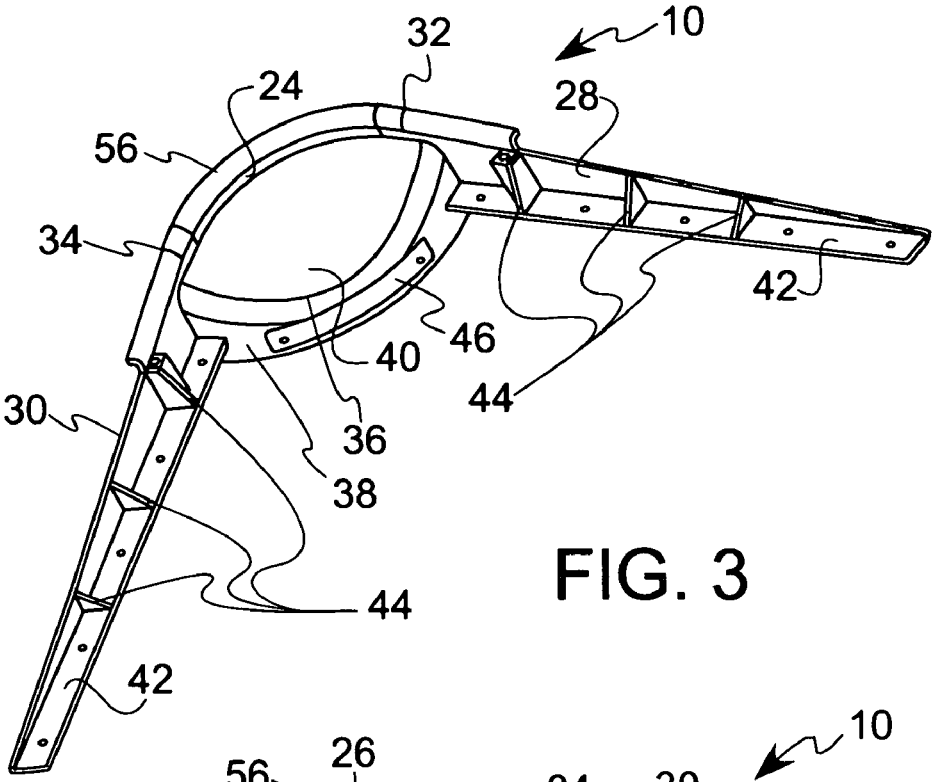
FIG. 3 is a perspective view thereof.
Figure 5:
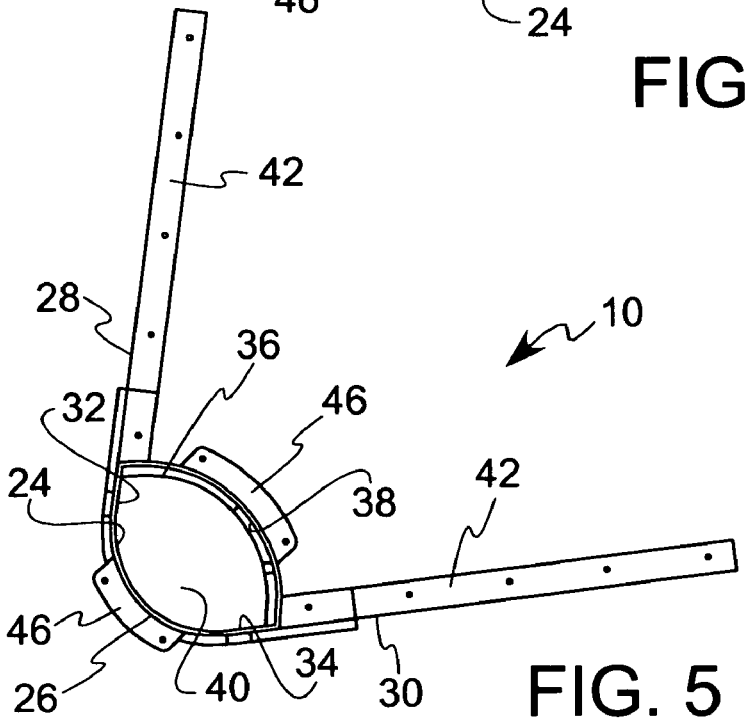
FIG. 5 is a bottom plan view thereof.

As illustrated in FIGS. 2, 3 and 5, the support member 36 preferably comprises a curved intermediate wall 38 extending between the side walls 28, 30 adjacent to the opposite ends 32, 34 of the leading wall 24 and a canopy 40 extending from the leading wall 24 to the intermediate wall 38. The leading wall 24 is higher than the intermediate wall 38, and the canopy is inclined downwardly from an upper portion of the leading wall 24 to an upper portion of the intermediate wall 38.

As illustrated in FIG. 3, a generally horizontal mounting member 42 and a plurality of relatively spaced apart reinforcing ribs 44 are preferably provided on each of the side walls 28, 30. The mounting members 42 extend horizontally and inwardly from the side walls 28, 30 and are generally coextensive therewith. The reinforcing ribs 44 extend generally vertically between the adjoined mounting members 42 and side wall 28, 30.

Figure 4:
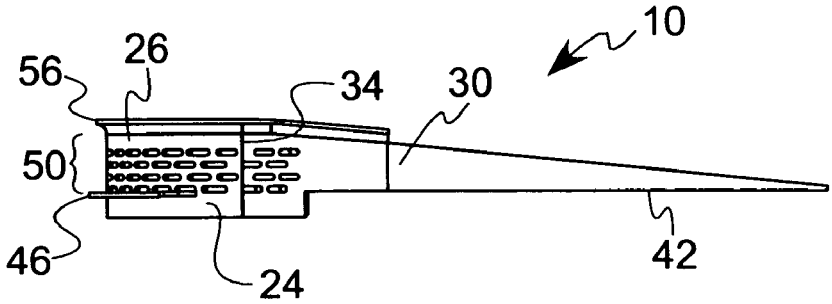
FIG. 4 is a side elevational view thereof.

As variously illustrated in FIGS. 2, 3, 4 and 5, the leading wall 24 and/or the intermediate wall 38 is preferably provided with a mounting flange 46. The mounting flange 46 is generally coplanar with the mounting members 42. Portions of the leading wall 24, side walls 26, 28 and intermediate wall 32 extend below the mounting members 42 and the flange 46. In this manner, the mounting members 42 and the flange 46 are adapted to be mounted on the gutter covers 12, 14. Those portions of the leading wall 24, side walls 28, 30 and intermediate wall 38 extending below the mounting flange 46 and members 42 are adapted to extend into an opening 48 (FIG. 2) formed in the adjoining gutter covers 12, 14. The leading wall 24 and adjacent portions of the side walls 28, 30 are preferably formed with a plurality of rainwater-receiving ports 50 (FIG. 4). The canopy 40, intermediate wall 38, leading wall 24 and adjacent portions of the side walls 28, 30 define an open-bottomed chamber 52 (FIGS. 2 and 5) through which rainwater entering from the ports 50 is directed into a gutter 54 (FIG. 2) disposed below the cover sections 12, 14. An outwardly curved upper lip 56 is preferably provided on the leading wall 24 and adjacent portions of the side walls 28, 30 to limit the amount of rainwater splashing or flowing over the walls 24, 28 and 30. As illustrated in FIG. 1, the present valley diverter 10 is sized and configured so that the leading wall 24 may be axially aligned with the valley 18. Rainwater which does not enter the ports 50 in the leading wall 24 and adjacent portions of the side walls 28, 30 is slowed and diffused by the side walls 28, 30 over outlying portions of the gutter cover sections 12, 14.

Figure 6:
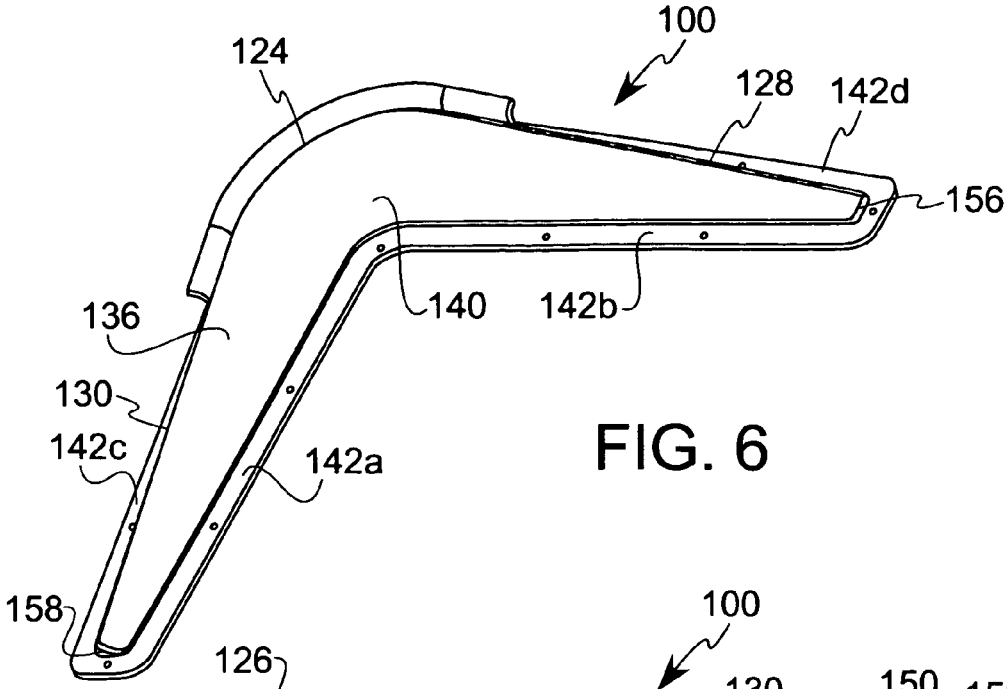
FIG. 6 is perspective view of a second preferred embodiment of a valley diverter according to the present invention.
Figure 7:
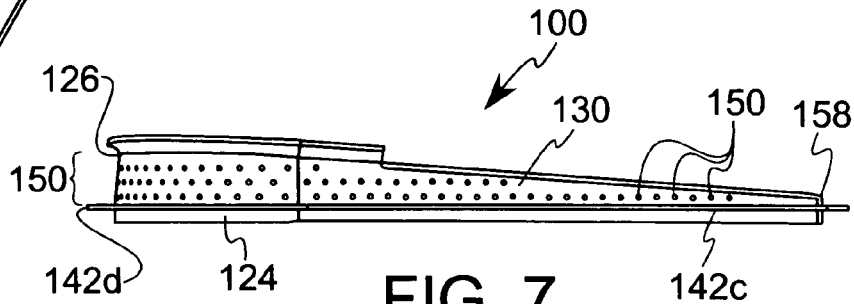
FIG. 7 is a side elevational view of the second embodiment.
Figure 8:
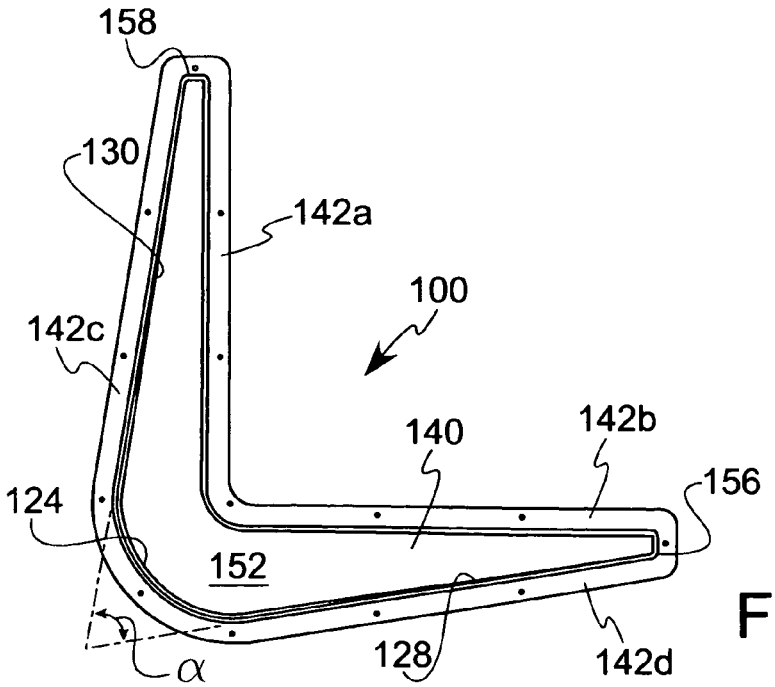
FIG. 8 is a bottom plan view of the second embodiment.

FIGS. 6, 7 and 8 illustrate a second embodiment of a valley diverter, generally designated 100, according to the present invention. In the second embodiment, the support member 136 preferably comprises a canopy 140 inclined downwardly from upper edges of the leading wall 124 and the tapered side walls 128, 130 to angularly inwardly adjoining strips 142A, 142B of a perimeter mounting member 142. The canopy 140 is coextensive with the side walls 128, 130. The mounting member 142 wraps around the outlying ends 156, 158 of the side walls 128, 130. The inwardly projecting strips 142A, 142B of the mounting member 142 are preferably disposed at approximately a ninety degree angle, or at another angle corresponding to the angle between the adjoining gutter cover sections 12, 14. The side walls 128, 130 are preferably disposed at a slightly smaller angle $\alpha$ (FIG. 8). The perimeter mounting member 142 is preferably continuous and includes strips 142C, 142D projecting from the outer surface 126 of the leading wall 124 and the side walls 128, 130.

The valley diverter according to the second embodiment 100 is preferably designed for larger volumes of rainwater than the first embodiment 10. The side walls 128, 130 are provided with a plurality of ports 150 (FIG. 7) throughout substantially their entire length, rather than in just the portion adjacent to the curved leading wall 124 (FIG. 4). The canopy 140 defines a larger water-receiving chamber 152 (FIG. 8) than the first embodiment (FIG. 5), and a larger opening (not shown) is provided in the adjoining gutter cover sections 12, 14 to receive portions of the side walls 128, 130, leading wall 124 and canopy 140 projecting below the perimeter mounting member 142 (FIG. 7).

Figure 9:
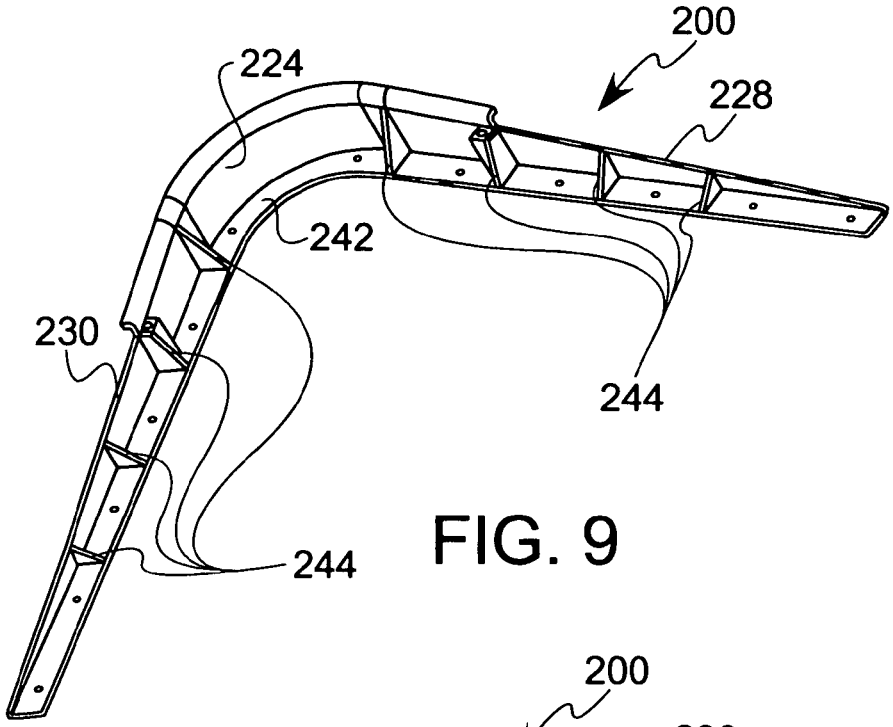
FIG. 9 is a perspective view of a third preferred embodiment of a valley diverter according to the present invention.
Figure 10:
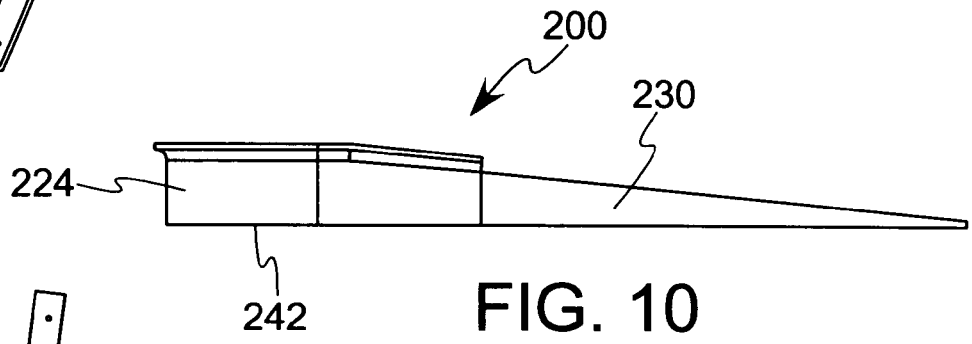
FIG. 10 is a side elevational view of the third embodiment.
Figure 11:
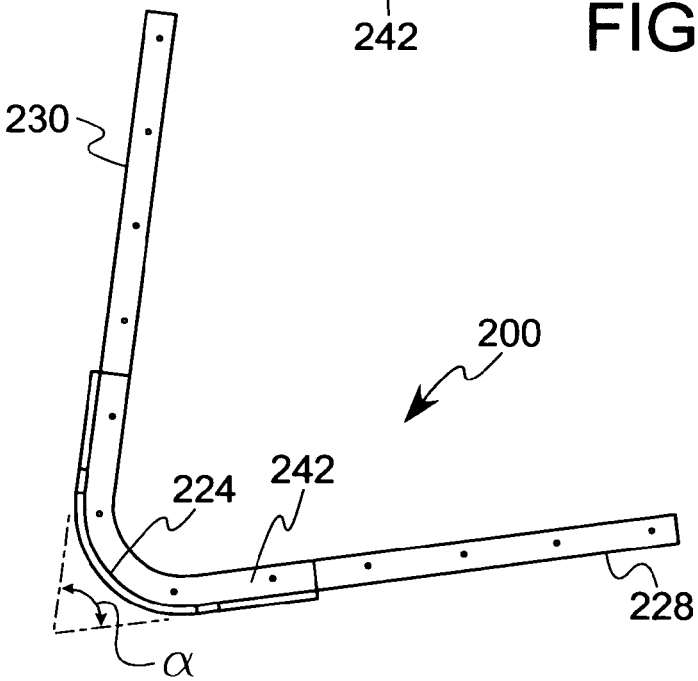
FIG. 11 is a bottom plan view of the third embodiment.

FIGS. 9, 10 and 11 illustrate a third embodiment of a valley diverter, generally designated 200, according to the present invention. In the third embodiment 200, the support member preferably comprises a mounting member 242 projecting inwardly from lower edges of the curved leading wall 224 and the side walls 228, 230. The mounting member 242 is preferably coextensive with all of the foregoing walls and is adapted to be mounted and fastened upon the adjoining gutter cover sections 12, 14 (FIG. 1). A plurality of spaced apart vertical ribs 244 extend between the side walls 228, 230 and the mounting member 242. The side walls 228, 230 of the third embodiment 200 are disposed at an angle $\alpha$, which is preferably less than ninety degrees.

The valley diverter according to the third embodiment 200 is preferably designed for smaller volumes of rainwater than the first embodiment 10. The leading wall 224 and the side walls 228, 230 are substantially imperforate (FIG. 10), rather than ported (FIG. 4). There is no canopy, nor any water-receiving chamber (FIGS. 9 and 11). The mounting member 242 is flush with the lower ends of the walls 224, 228, 230 (FIG. 10) so there are no lower portions, nor an opening in the adjoining gutter cover sections 12, 14 to receive them. The valley diverter according to the third embodiment 200 simply slows and diffuses the rainwater over outlying portions of the gutter cover sections 12, 14.

While three preferred embodiments of the present invention have been illustrated and described in detail, the foregoing disclosure is not intended to unduly limit or restrict the spirit of the invention or the scope of the following claims.

The invention claimed is:

1. A valley diverter adapted to be mounted on angularly adjoining gutter cover sections adjacent to a lower end of a valley between two adjacent roof slopes, said valley diverter comprising:

a leading wall having a generally vertical convex outer surface, said leading wall being adapted to be disposed close to the valley than any other portion of said valley diverter;

first and second generally straight and elongated side walls extending generally tangentially from and tapering downwardly from opposite ends of the leading wall and defining an angle of ninety degrees or less; and a support member extending between and behind the leading wall and the side walls;

wherein the leading wall and adjacent portions of the side walls are formed with a plurality of rainwater-receiving ports.

2. The valley diverter of claim 1, wherein the support member comprises an intermediate wall extending between the side walls and a canopy extending from the leading wall to the intermediate wall.

3. The valley diverter according to claim 2, wherein the intermediate wall is curved.

4. The valley diverter according to claim 2, wherein the intermediate wall extends between portions of the side walls which are adjacent to opposite ends of the leading wall.

5. The valley diverter according to claim 2, wherein the leading wall is higher than the intermediate wall and the canopy inclines downwardly from an upper portion of the leading wall to an upper portion of the intermediate wall.

6. The valley diverter according to claim 2, wherein a mounting member extends generally horizontally and inwardly from each of the side walls.

7. The valley diverter according to claim 6, wherein the mounting members are generally longitudinally coextensive with the side walls.

8. The valley diverter according to claim 6, wherein a plurality of relatively spaced apart ribs extend generally vertically between the adjoining mounting members and side walls.

9. The valley diverter according to claim 6, wherein at least one of the leading wall and the intermediate wall is provided with a mounting flange.

10. The valley diverter according to claim 9, wherein the mounting flange is generally coplanar with the mounting members.

11. The valley diverter according to claim 10, wherein portions of the leading wall, the side walls and the intermediate wall extend below the mounting members and the mounting flange.

12. The valley diverter according to claim 2, wherein the canopy, the intermediate wall, the leading wall and adjacent portions of the side walls define an open-bottomed chamber.

13. The valley diverter according to claim 1, wherein an outwardly curved upper lip is provided on the leading wall and on adjacent portions of the side walls.

14. The valley diverter according to claim 1, wherein the support member comprises a canopy extending inwardly and downwardly from upper edges of the leading wall and side walls.

15. The valley diverter according to claim 14, wherein the leading wall and the side walls are provided with a plurality of ports throughout substantially their entire length.

16. The valley diverter according to claim 14, wherein the leading wall, the side walls and the canopy define an open bottomed chamber.

17. The valley diverter according to claim 14, wherein the canopy is substantially coextensive with the side walls.

18. The valley diverter according to claim 14, wherein a perimeter mounting member extends generally horizontally from the leading wall, the side walls and the canopy.

19. The valley diverter according to claim 18, wherein portions of the leading wall, the side walls and the canopy extend below the perimeter mounting member.

20. The valley diverter according to claim 19, wherein the perimeter mounting member extends around an outlying end of each of the side walls.

21. The valley diverter according to claim 20, wherein the portion of the perimeter mounting member extending from the canopy is comprised of a pair of angularly related strips projecting inwardly from the outlying ends of the side walls.

* * * * *